United States Patent [19]

Kane

[11] Patent Number: 4,704,588

[45] Date of Patent: Nov. 3, 1987

[54] MICROSTRIP CIRCULATOR WITH FERRITE AND RESONATOR IN PRINTED CIRCUIT LAMINATE

[75] Inventor: Robert C. Kane, Woodstock, Ill.

[73] Assignee: Motorola, Inc., Schaumburg, Ill.

[21] Appl. No.: 880,221

[22] Filed: Jun. 30, 1986

[51] Int. Cl.[4] ..... H01P 1/387

[52] U.S. Cl. ..... 333/1.1; 333/238

[58] Field of Search ..... 333/1.1, 24.2

[56] References Cited

U.S. PATENT DOCUMENTS

| | | | |
|---|---|---|---|
| 3,334,317 | 8/1967 | Andre | 333/1.1 |
| 3,359,510 | 12/1967 | Geiszler | 333/1.1 |
| 3,636,479 | 1/1972 | Hartz, et al. . | |
| 3,733,563 | 5/1973 | Poirier . | |
| 4,016,510 | 4/1977 | Hodges, III et al. . | |
| 4,101,850 | 7/1978 | Dworsky et al. . | |
| 4,359,701 | 11/1982 | Aoki . | |
| 4,496,915 | 1/1985 | Mathew et al. . | |

FOREIGN PATENT DOCUMENTS

| | | | |
|---|---|---|---|
| 1428384 | 3/1976 | United Kingdom . | |
| 2129623 | 5/1984 | United Kingdom | 333/1.1 |

*Primary Examiner*—Paul Gensler

*Attorney, Agent, or Firm*—Raymond A. Jenski; Rolland R. Hackbart

[57] ABSTRACT

A microstrip circulator is disclosed in which a resonator (311) is metalized on one layer (309) of a multilayer printed circuit board (301) and a ferrite element (305) is disposed in another layer (303) of the circuit board. Input/output port termination mismatch due to port lead misalignment is eliminated and ferrite to resonator coupling is accomplished in a simple and repeatable manner.

16 Claims, 11 Drawing Figures

—PRIOR ART—

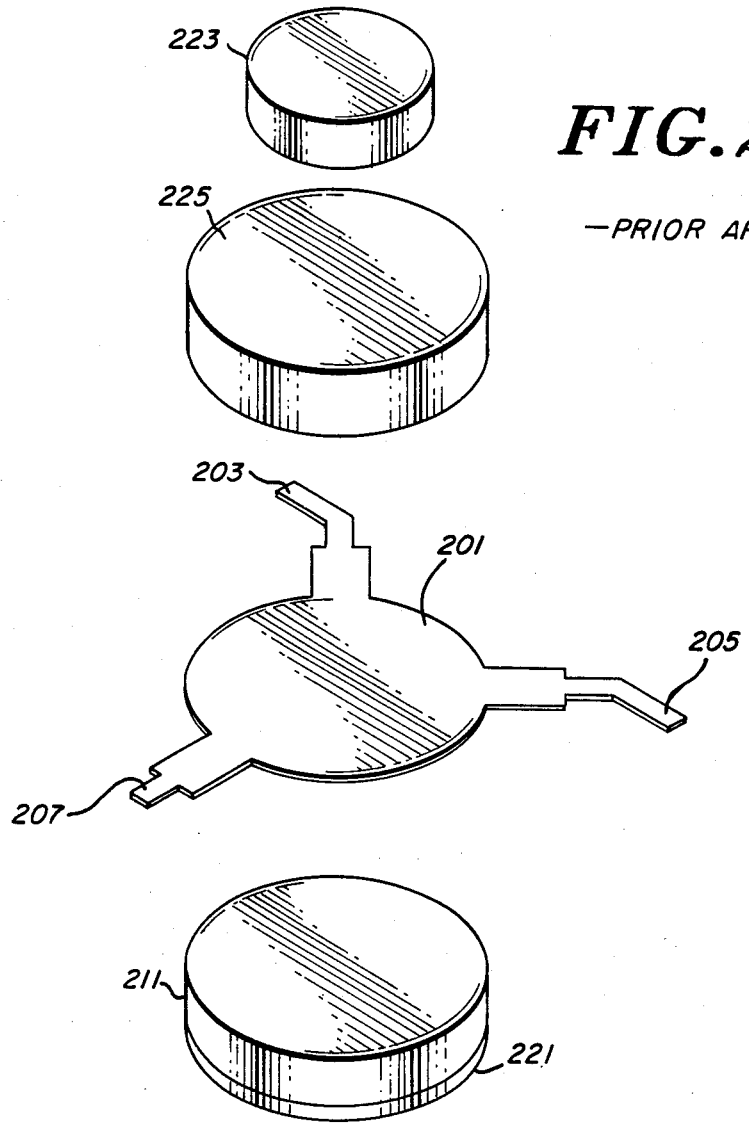
FIG. 2A
—PRIOR ART—
FIG. 2B
—PRIOR ART—
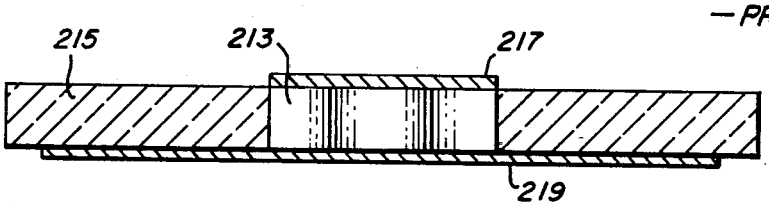

MICROSTRIP CIRCULATOR WITH FERRITE AND RESONATOR IN PRINTED CIRCUIT LAMINATE

BACKGROUND OF THE INVENTION

This invention relates generally to non-reciprocal radio frequency devices and more particularly to the construction of circulators and isolators employing printed circuit microstrip resonators and ferrite disposed in layers of a multi-layer printed circuit laminate. Reference is made to copending patent application number 880,220 "Circulator/Isolator Resonator" filed on behalf of Robert C. Kane et al. on the same date as the present invention and containing related subject matter.

Circulators and isolators are well known radio frequency devices which exhibit non-reciprocal properties. A common form of circulator is that of a three-port device which couples a radio frequency signal from a first port to a second port with virtually no attenuation of the signal but which significantly attenuates a signal coupled from the second port to the first port. The signal applied at the second port is coupled to a third port. Likewise, a signal applied at the third port is coupled to the first port but greatly attenuated at the second port. Thus, the effect of the circulator is to isolate the ports from each other in one direction (ie. ports 1-3-2-1) and to couple the ports sequentially to each other in the other direction (ports 1-2-3-1).

Physical construction of circulators can be realized in resonant structures such as radio frequency resonant cavities and in waveguide at higher frequencies. Circulators may also be realized in planar configuration using stripline or microstrip technology which employ a planar resonating element between two ground plane conductors (stripline) or coupled to a single ground plane conductor (microstrip).

A microstrip circulator is typically constructed of an essentially planar resonating element having regularly spaced ports coupled to the periphery of the resonating element (resonator). The resonator is closely coupled to one or more elements exhibiting gyromagnetic properties (typically a ferrite material) and a magnetic field is applied perpendicular to the resonator and through the ferrite. When a radio frequency signal is applied at one port, the ferrite atoms, which have their magnetic spin vectors preferentially aligned along the magnetic lines, precess in one rotational direction. This precession favors coupling of the radio frequency signal from the port of application to the next port in the direction of the spin precession.

The preferential coupling of radio frequency signal from one port to another may be employed in a more particular application of a circulator known as an isolator. An isolator has one of the ports terminated in a resistance which matches the characteristic impedance of the circulator. This device permits radio frequency signal to propagate in one direction but blocks the propagation in the opposite direction (because the radio frequency signal energy is dissipated in the terminating resistance). This device also presents a relatively constant impedance to both the input and the output ports. Consequently, isolators are used extensively in radio transmitters and receivers where the impedance presented to an amplifying stage must be maintained close to the input or output impedance of the stage or where reflected energy could produce undesired effects or damage.

The quality of circulators and isolators is generally measured by the insertion loss in the direction of signal coupling, the amount of attenuation in the opposite direction, the impedance of each port, and the band of frequencies over which these characteristics are maintained. Optimization of these characteristics is the goal of circulator designers and has resulted in increasingly complex and expensive techniques of aligning the resonator, the ferrite, and the magnet. Additionally, improvements in cost and complexity of circulators has been realized by employing microstrip technologies rather than stripline technologies. Since microstrips require only a single groundplane and a majority of the propagating electromagnetic field is contained between the single conductor and the groundplane, only one ferrite and associated hardware is necessary to non-reciprocally transfer an applied radio frequency signal from one port of the circulator to another. Practical realizations of microstrip circulators, however, have produced circulators which require more volume than comparable stripline circulators.

SUMMARY OF THE INVENTION

Therefore, it is one object of the present invention to simply and easily enable the alignment of the resonator, the ferrite, and the magnet of a circulator or isolator.

It is a further object of the present invention to reduce the impedance mismatch at the ports of the circulator or isolator.

Accordingly, these and other objects are achieved in the present invention which encompasses the method and apparatus which reduce the input/output port termination mismatch of a microstrip circulator. The present invention employs a multilaminate dielectric circuit board disposed between opposite poles of a magnet. The multilaminate circuit board has the circulator resonator and associated input/output port leads metalized on one layer of the multilaminate circuit board and the ferrite element disposed in another layer of the multilaminate circuit board. The circuit board is arranged such that the two layers are in contact with each other and the ferrite is aligned substantially opposite the resonator.

BRIEF DESCRIPTION OF THE DRAWINGS

FIG. 2A is an exploded perspective view of a conventional microstrip circulator.

FIG. 2B is a cross sectional view of a conventional microstrip circulator in which the ferrite is placed in the substrate.

DESCRIPTION OF THE PREFERRED EMBODIMENT

Figure 1:
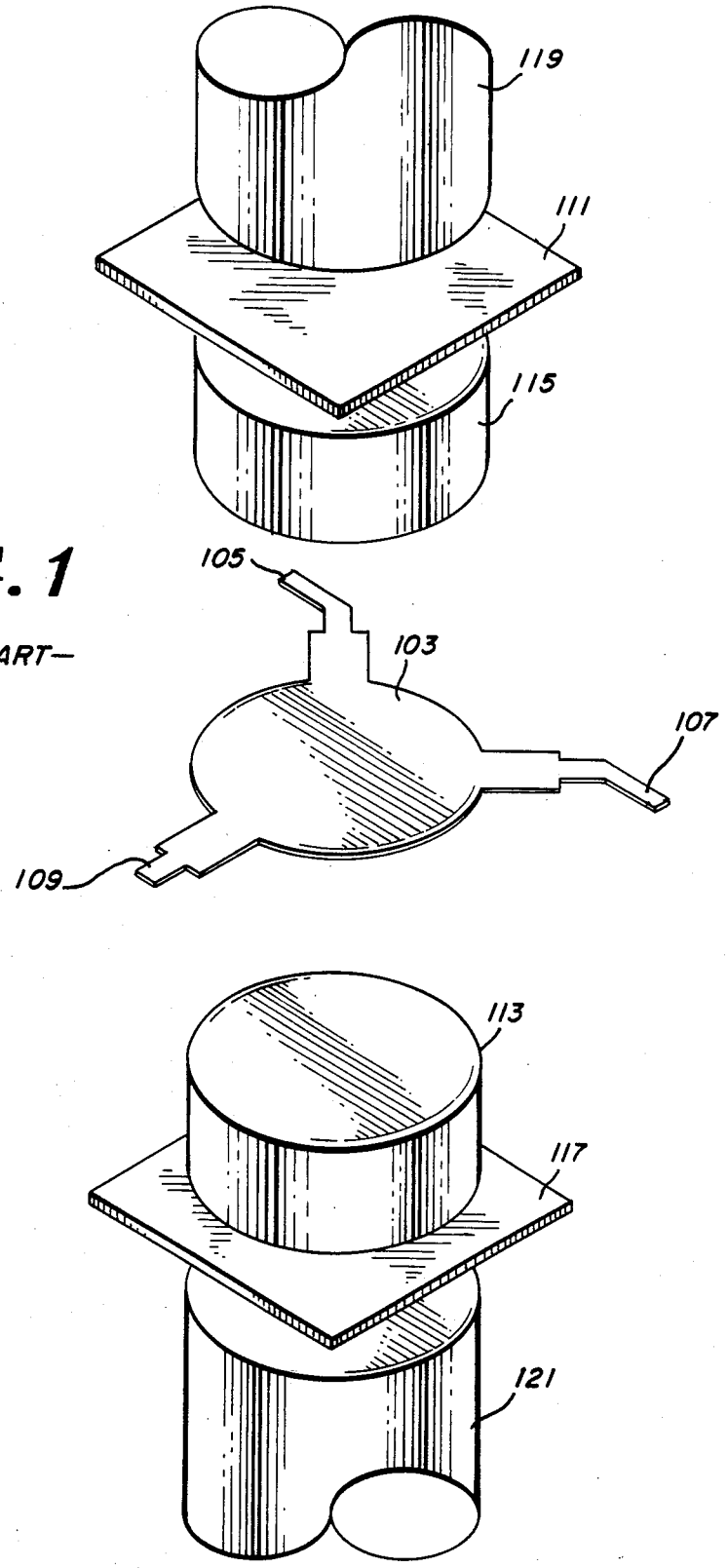
FIG. 1 is an exploded perspective view of conventional stripline circulator construction.

A circulator employing conventional stripline construction is shown in FIG. 1. This construction typically employs conductive resonator 103 coupled to external circuitry via input/output port leads 105, 107, and 109. Gyromagnetic material forms the dielectric between the resonator 103 and ground planes above (111) and below (117) the resonator 103, and is usually several pieces of ferrite, shown here as ferrites 115 and 113. The sandwich of ferrites 115 and 113 and resonator 103 along with ground planes 111 and 117 are secured between opposite poles of a biasing magnet shown as magnets 119 and 121. Depending upon particular requirements of the circulator, a high permeability spacer (not shown) may be used to focus or spread the magnetic field. Additionally, a high permeability housing is typically used to contain the sub-components of the device and direct the field of the biasing magnet.

A conventional microstrip circulator is shown in FIG. 2A. In this implementation, a resonator 201 and input/output port leads 203, 205, and 207 may be realized as a discrete sub-component. Other implementations may have the resonator 201 metalized on a substrate, metalized directly upon the ferrite material 211, or utilize a precision fit between ferrite 213 and substrate 215 as shown in cross section in FIG. 2B. (The resonator 217 is metalized over the fitted ferrite 213 on one face of the substrate and a ground plane 219 is metalized over the interface between ferrite 213 and substrate 215 on the opposite substrate face). Considering again the circulator of FIG. 2A, the microstrip ground plane 221 is typically metalized on the ferrite 211 opposite the resonator 201. One or more magnets, shown as 223, provide magnetic bias for the ferrite 211 and may be separated from the resonator 201 by a non-magnetic spacer 225.

Figure 3A:
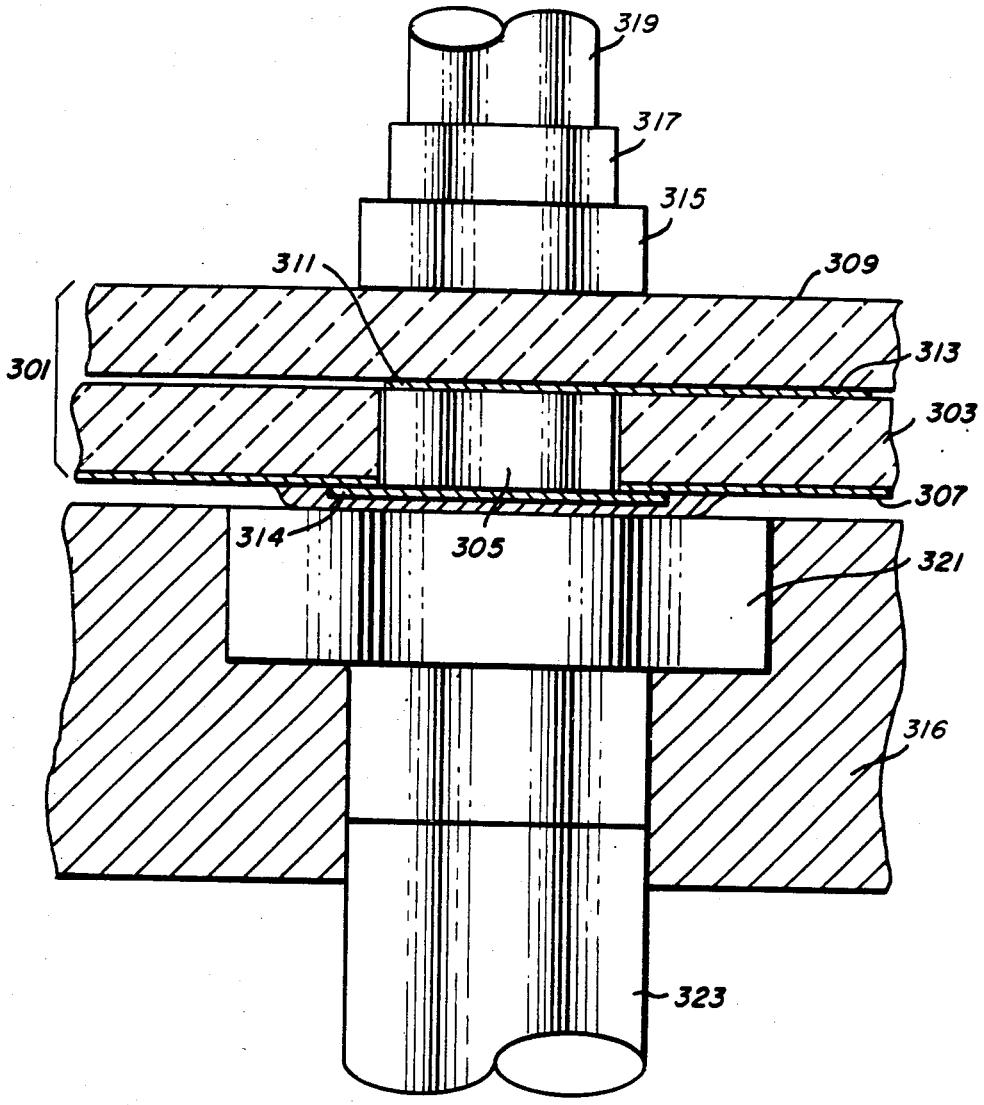
FIG. 3A is a cross sectional view of one preferred embodiment of a microstrip circulator employing the present invention.

A cross-section of the circulator of the present invention in an embodiment employing a rigid mounting surface and an electromagnet is shown in FIG. 3A. (Construction of an isolator could be identical although one of the circulator ports would be terminated in a resistance equal to the characteristic impedance of the circulator). In order that the circulator of the present invention simplify alignment of the various components during construction and maintain optimum match between the output ports of the circulator and external circuit components, a multilayer printed circuit board 301 is employed. One of the laminations 303 (or layers) of printed circuit board 301 is fabricated with a hole from one side of the lamination 303 to the other such that a ferrite 305 may be emplaced at least partly in this area. In the present invention, the class of fit between the ferrite 305 and the lamination 303 is not critical. It is desirable that the ferrite 305 be easily inserted and removed from the hole; consequently, the preferred embodiment uses a clearance of at least .001 inch between ferrite and substrate. This loose fit could not be tolerated in earlier designs employing ferrite embedded in a substrate. Additionally, one side of the lamination 303 may be metalized to provide a ground plane 307.

A second lamination 309 of the printed circuit board 301 is metalized with the circulator resonator 311 and its port leads 313. Lamination 309 is held in contact with lamination 303 by conventional bonding techniques used for multi-laminate printed circuit board fabrication in the preferred embodiment and the resonator 311 is held into close contact with ferrite 305 by securing a conducting bottom plate 314 to the ground plane 307 by solder, by compression of the circulator assembly with the magnet pole pieces 319 and 323, or other means.

In order to reduce the losses through the capacitance formed by resonator 311 and pole piece 319, a dielectric insulating spacer 315 may be interposed between pole piece 319 and the printed circuit board assembly 301. A steel insert 321 aids in the completion of the magnetic circuit to the pole piece 323. The entire assembly may then be secured to an aluminum chassis 316 for mechanical stability. A spacer 317 may be used to further aid in distributing the magnetic field.

The embodiment illustrated in FIG. 3A is particularly useful when pole pieces 319 and 323 are parts of an electromagnet. Pole pieces 319 and 323 may alternatively be realized as permanent magnets. The use of permanent magnets for bias enables a further simplification in the design of a circulator employing the present invention.

Figure 3B:
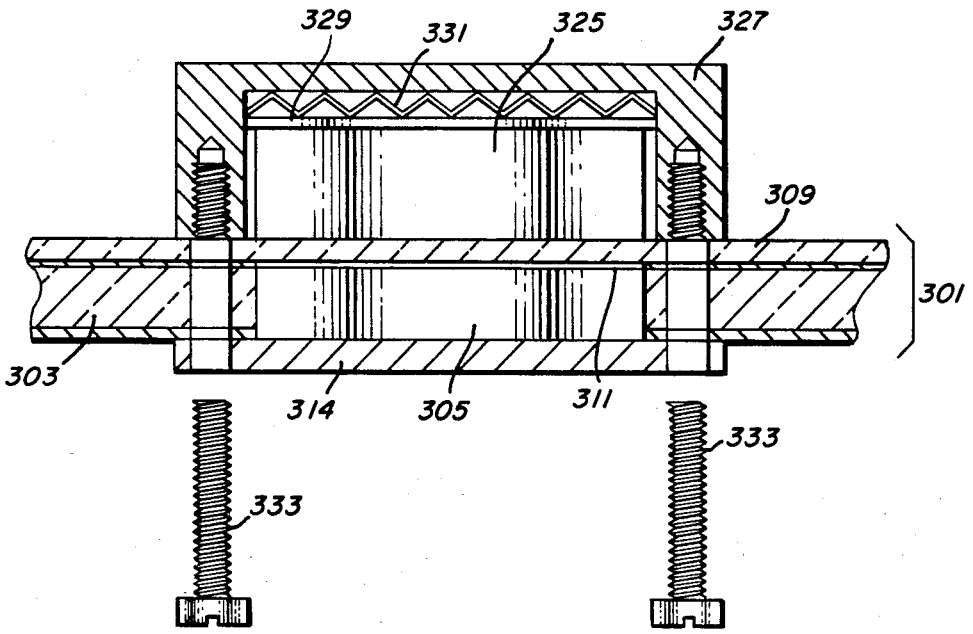
FIG. 3B is a cross sectional view of a preferred embodiment of the present invention employing a single permanent magnet for biasing.

The cross sectional diagram of FIG. 3B shows an embodiment of the present invention employing a permanent magnet 325. A high permeability housing 327 and conducting plate 314 are secured to the multilaminate printed circuit board 301 and each other to provide mechanical stability to the circulator. Copper and cold rolled steel (CRS) shims 329 are employed to tune and distribute the magnetic bias field. A CRS spring 331 is used to hold the entire assembly in compression when housing 327 is assembled using high permeability fasteners 333.

Figure 4A:
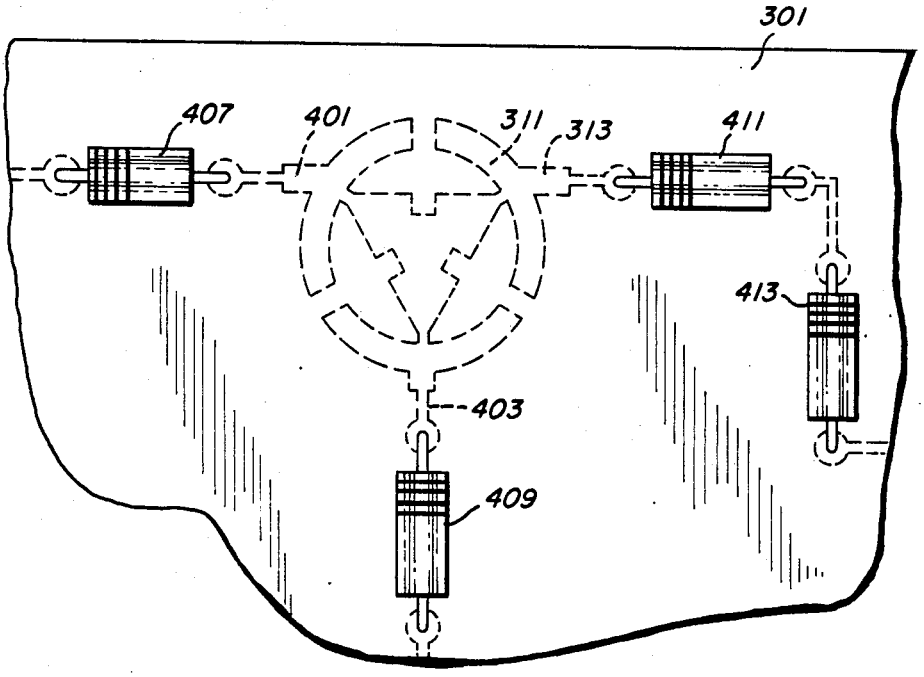
FIG. 4A is a top view of the printed circuit board illustrating the resonator of the present invention coupled to external components.
Figure 4B:
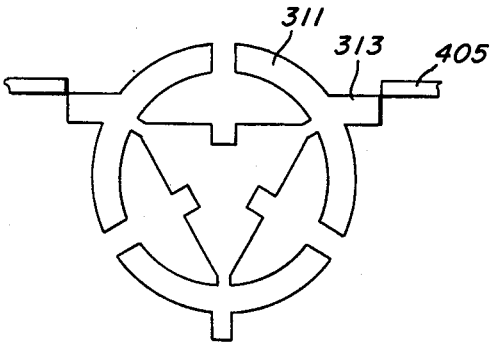
FIG. 4B is a bottom view of the resonator showing the port leads misaligned, a condition which the present invention alleviates.

Referring now to FIG. 4A, a section of laminated printed circuit board 301 is shown in top view. One of the features of the present invention is that the port leads 313, 401, and 403 of the circulator resonator 311 may be arranged such that impedance mismatch is minimized. Since the port leads and the resonator 311 are formed as part of the metalization of the entire circuit board, there is no mismatch due to improper port lead placement as indicated in FIG. 4B. FIG. 4B illustrates potential misalignment of port lead 313 and external circuit connection 405 which is possible for a non-integral resonator 311, i.e. not metalized as part of the external circuit. Other translational and rotational misalignments were also possible before the solution provided by the present invention. Further, as shown in FIG. 4A, associated circuitry shown as external components 407, 409, 411, and 413, for example, may be added to the topside of printed circuit board 301 thereby incorporating the circulator resonator 311 directly into the associated circuitry without the need for terminating connectors or tabs. Thus, an entire electronic assembly including a circulator may be fabricated on a single multilaminate printed circuit board with components on one side of a layer, a metalized resonator as part of the printed circuit wiring on a second side of a layer, and in physical contact with a ferrite located in a second layer of the printed circuit board 301.

Figure 6:
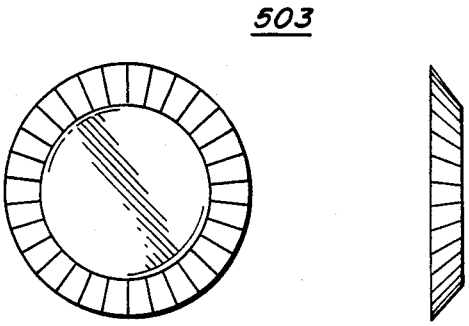
FIG. 6 is a diagram of a shim which may be employed in the present invention.
Figure 5:
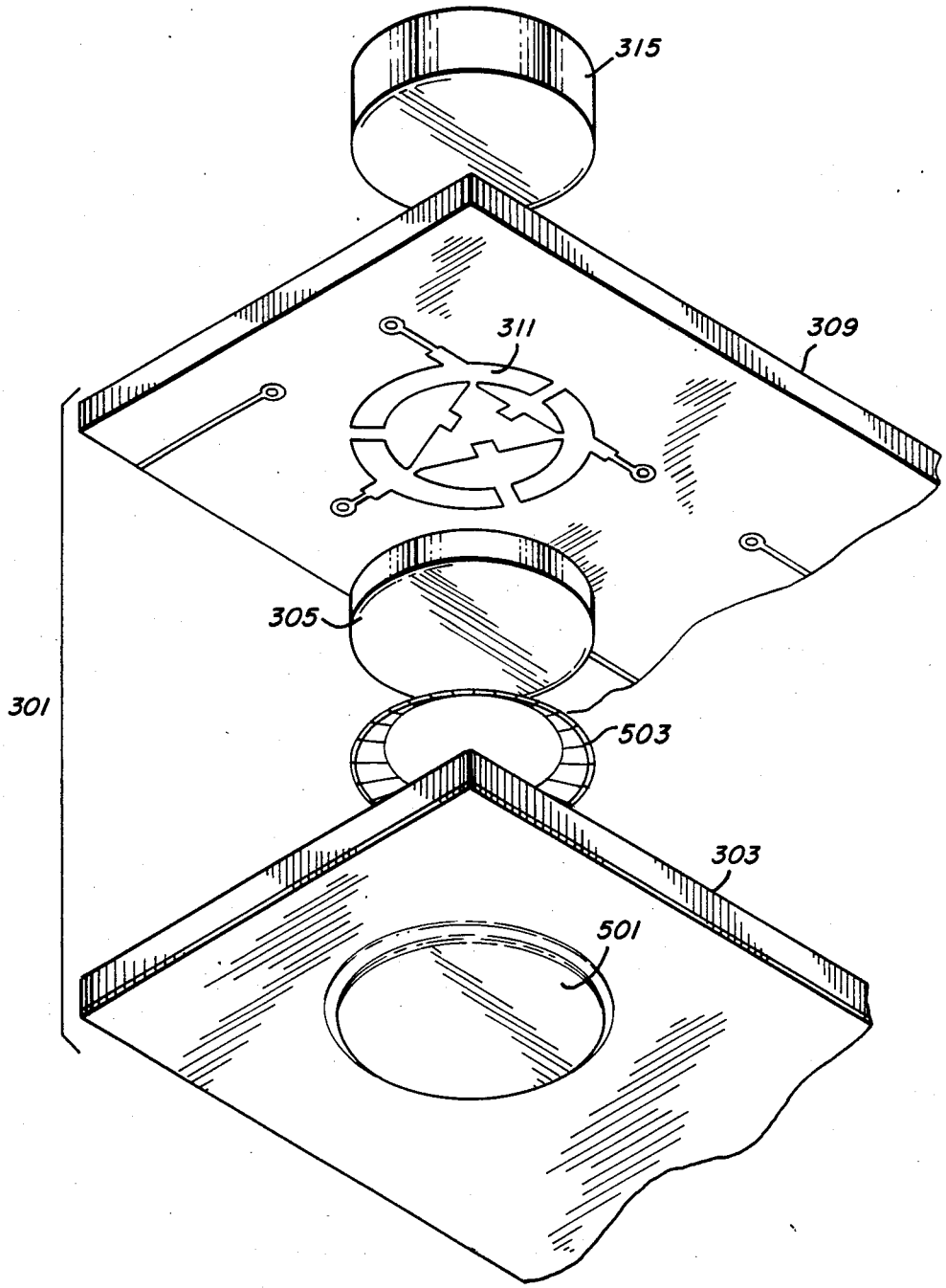
FIG. 5 is a bottom exploded perspective view of the circulator of the present invention showing two laminations of the circuit board and the relative locations of the resonator and ferrite.
Figure 7A:
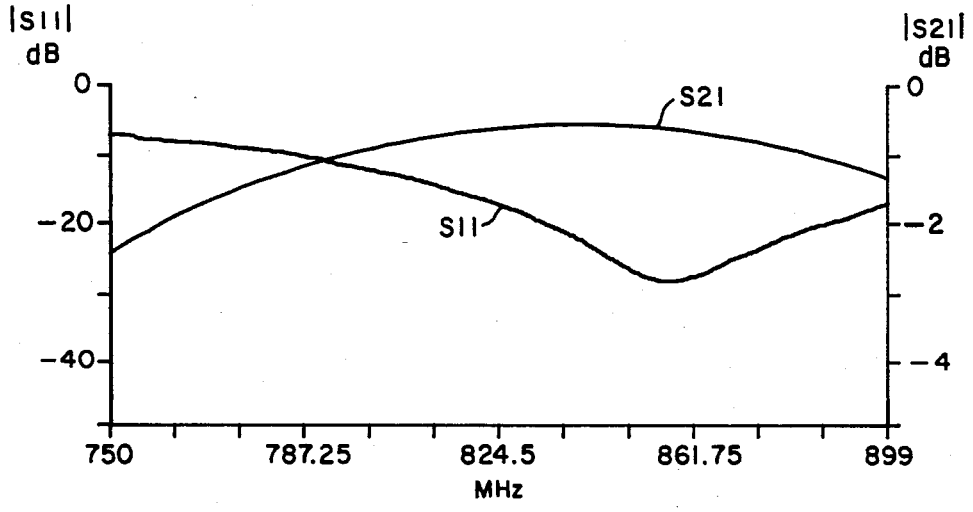
FIGS. 7A and 7B are graphs plotting the magnitude of the scattering parameters of an isolator employing the present invention.
Figure 7B:
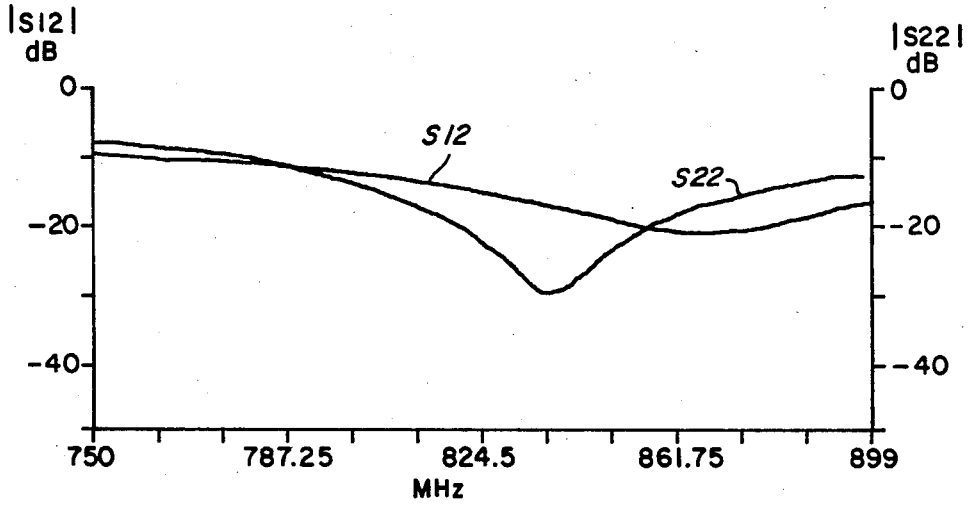

A bottom exploded perspective view of the circulator of the present invention is shown in FIG. 5. Here, it can be seen that the ferrite 305 is carried in lamination 303 and in physical contact with the resonator 311 metalized on layer 309 of the printed circuit board 301. Locating ferrite 305 in a hole in lamination 303 permits effective coupling of energy between the ports of the circulator. In the preferred embodiment of the present invention, a permeable metal backer 501 is added to the bottom ground plane of layer 303 to support the ferrite 305 and provide the necessary ground plane for the microstrip circulator resonator 311. Additionally, a copper plated CRS shim stock 503 shown in FIG. 6 may be disposed between the ferrite and metal backer 501. Shim stock 503 is a circular piece with a serrated dished edge formed to maintain positive electrical contact with the ground plane. When placed in compression, the serrated edge is forced outward against the walls of the hole in layer 303. In one implementation of the preferred embodiment, the walls of the hole are metallized with ground plane thereby providing a conductive surface for the grounding of shim 503.

Performance of a circulator constructed in accordance with the present invention is shown in the scattering parameter graphs of 7A and 7B. When tuned for an operating center frequency of 835.6 MHz, and employing a 0.580 inch resonator diameter on a 0.015 inch thick printed circuit board with a dielectric constant of 4.8. The ferrite was 0.656 inches in diameter, 0.030 inches thick, having a dielectric constant of 15. When a magnetic biasing field of 1600 Gauss was applied, an insertion loss ($S_{21}$) equal or less than $-0.5$ db was achieved over the band of 812 MHz to 851 MHz. Additionally, a reverse isolation ($S_{12}$) exceeded $-18$ dB over the same frequency range.

In summary then, a physically small circulator operating in the 800 MHZ to 900 MHZ frequency band has been realized in microstrip technology. Because of its small size this circulator may be constructed using a multilayer laminate printed circuit board. Such construction enables the port leads of the circulator resonator to be formed as part of the metalization of the printed circuit board and termination mismatch due to misalignment of the port leads with external circuitry is eliminated. Placement of a hole in a printed circuit board lamination directly opposite the resonator of the circulator enables a ferrite to be simply placed in proper alignment with the resonator to enable effective coupling of radio frequency energy between the ports of the circulator. Therefore, while a particular embodiment of the invention has been shown and described, it should be understood that the invention is not limited thereto since modifications unrelated to the true spirit and scope of the invention may be made by those skilled in the art. It is therefore contemplated to cover the present invention and any and all such modifications in the following claims.

I claim:

1. A method of reducing the input/output port termination mismatch of a microstrip circulator employing a dielectric circuit board having at least two layers and disposed in a biasing magnetic field, comprising the steps of:

metalizing a circulator resonator and associated input/output port leads on a first side of a first layer of the circuit board; and emplacing a ferrite element at least partially in a second layer of the circuit board and securing a first side of said second layer to said first side of said first layer with said ferrite element substantially opposite said circulator resonator.

2. A method in accordance with the method of claim 1 further comprising the step of disposing an electrical ground plane for said circulator resonator on said second layer of said second side.

3. A method in accordance with the method of claim 2 further comprising the step of grounding said ferrite element to said electrical ground plane.

4. A method in accordance with the method of claim 1 further comprising the step of modifying the biasing magnetic field with a metal shim.

5. A microstrip circulator having reduced input/output port termination mismatch comprising:

a dielectric circuit board disposed in a biasing magnetic field and having at least first and second layers, each said layer having first and second sides;

a circulator resonator and associated input/output port leads metallized on said first side of said first layer; and a ferrite element disposed at least partially in a second layer of said circuit board, and a first side of said second layer contacting said first layer first side with said ferrite element substantially opposite said circulator resonator metalization.

6. A microstrip circulator in accordance with claim 5 wherein said circuit board further comprises an electrical ground plane for said circulator resonator disposed on said second side of said second layer.

7. A microstrip circulator in accordance with cliam 6 further comprising a conducting shim disposed between said ferrite element and said electrical ground plane.

8. A microstrip circulator in accordance with claim 5 wherein said circulator further comprises at least one metal spacer whereby said magnetic field may be modified.

9. A microstrip circulator in accordance with claim 5 wherein said biasing magnetic field is produced by a permanent magnet.

10. A microstrip circulator in accordance with claim 9 wherein said circulator further comprises at least one dielectric spacer disposed between said permanent magnet and said first layer of said circuit board.

11. A circuit board microstrip circulator assembly having reduced input/output port termination mismatch comprising:

a dielectric circuit board having at least first and second layers, each layer having first and second sides;

a circulator resonator and associated input/output port leads metallized on said first side of said first layer;

utilization means disposed on said second side of said dielectric circuit board first layer and connected to said input/output port leads; and a magnetically biased ferrite element disposed at least partially in a second layer of said circuit board, and a first side of said second layer contacting said first layer first side with said ferrite element substantially opposite said circulator resonator metalization.

12. A circuit board microstrip circulator assembly in accordance with claim 11 further comprising an electrical ground plane for said circulator resonator disposed on said second side of said second layer.

13. A circuit board microstrip circulator assembly in accordance with claim 12 further comprising a conducting shim disposed between said ferrite element and said electrical ground plane.

14. A circuit board microstrip circulator assembly in accordance with claim 11 wherein said magnetically biased ferrite element is magnetically biased by a permanent magnet.

15. A circuit board microstrip circulator assembly in accordance with claim 14 wherein said permanent magnet further comprises at least one metal shim.

16. A circuit board microstrip circulator assembly in accordance with claim 14 wherein said circulator further comprises at least one dielectric spacer disposed between said permanent magnet and said first layer of said circuit board.

* * * * *